US006088870A

United States Patent [19]

Hohlbein

[11] Patent Number: 6,088,870

[45] Date of Patent: Jul. 18, 2000

[54] TOOTHBRUSH HEAD WITH FLEXIBLY MOUNTED BRISTLES

[75] Inventor: Douglas J. Hohlbein, West Trenton, N.J.

[73] Assignee: Colgate-Palmolive Company, New York, N.Y.

[21] Appl. No.: 09/247,401

[22] Filed: Feb. 10, 1999

[51] Int. Cl.[7] ..... A46B 9/04

[52] U.S. Cl. ..... 15/167.1; 15/201

[58] Field of Search ..... 15/159.1, 160, 15/167.1, 171, 201, 205.2

[56] References Cited

U.S. PATENT DOCUMENTS

| | | | |
|---|---|---|---|
| 2,722,031 | 11/1955 | Bressler | 152/201 |
| 2,730,747 | 1/1956 | Bressler | 15/201 |
| 4,423,531 | 1/1984 | Wall | 15/201 |
| 4,633,542 | 1/1987 | Taravel . | |
| 5,355,546 | 10/1994 | Scheier et al. . | |
| 5,483,722 | 1/1996 | Scheier et al. . | |
| 5,651,158 | 7/1997 | Halm . | |
| 5,774,923 | 7/1998 | Halm . | |
| 5,813,079 | 9/1998 | Halm . | |
| 5,836,036 | 11/1998 | Ivory | 15/205.2 |
| 5,839,149 | 11/1998 | Scheier et al. . | |

FOREIGN PATENT DOCUMENTS

| | | |
|---|---|---|
| 175 084 B1 | 10/1991 | European Pat. Off. . |
| WO 98/35584 | 8/1998 | WIPO . |

*Primary Examiner*—Randall E. Chin
*Attorney, Agent, or Firm*—Henry S. Goldfine

[57] ABSTRACT

The present invention relates to a toothbrush having bristles mounted on a flexibly resilient lattice network, such that the bristles deflect during brushing to conform to the various arcuate surfaces of the teeth for more effective cleaning thereof.

7 Claims, 2 Drawing Sheets

TOOTHBRUSH HEAD WITH FLEXIBLY MOUNTED BRISTLES

FIELD OF THE INVENTION

The present invention relates to toothbrush heads and more particularly to toothbrush heads having bristles mounted in a flexibly resilient network, such that the bristles deflect to conform to the configuration of the teeth.

BACKGROUND OF THE INVENTION

Conventional toothbrushes comprise uniform tufts of bristles each having a first end which is held captive in and fixed to a brush head, and a second end which is free and which is used for brushing. The free ends of the various tufts present a surface envelope which is capable of slight deformation by the bristles bending when they come in contact with a surface to be brushed, but which is incapable of adequately matching a surface having a complex shape with varying levels. Such a complex surface is present in the mouth, wherein the teeth generally lie in a "C" shaped curve within the upper and lower jaw, each row of teeth consequently having a convex outer curve and a concave inner curve. Further, the teeth themselves are contoured in an arcuate shape having significantly varying levels, including a deep "V" shaped interproximal area between one tooth and the next.

The desire of users to cause the bristles to conform to the teeth and to penetrate the interproximal spaces between the teeth is expressed by the forceful application of the brush to adequately deform the bristles to the arcuate contours of the dentiture. Such forceful application of the brush against the teeth merely leads to excessive wear of the tooth surfaces and gums, without adequate conformation of the brush about and between the teeth to provide the desired cleaning.

Toothbrushes such as those disclosed in PCT WO 98/35584, having bristle tufts capable of a toggling movement partially address the above problem. PCT WO 98/35584 discloses bristle tufts mounted in a resilient material held within an array of rigid receptacles or wells whose connection to the overall frame or skeleton of the brush has been broken. As the tufts are solely connected to the brush by the resilient material they will independently toggle or move in all planes (upwards/downwards/sideways). However, such independent motion of the bristles will not cause them to conform to the configuration of the teeth.

U.S. Pat. No. 4,633,542 discloses a toothbrush in which the bristles are slidably mounted within a rigid head, resting upon a resiliently deformable membrane. There is a cavity within the head of the toothbrush below the membrane, such that the bristles are resiliently forced into the head as the bristles are applied to the teeth. This independent motion of the bristles, in one plane, will not cause them to conform to the sloping, arcuate, surfaces of the teeth.

U.S. Pat. Nos. 5,355,546, 5,483,722 and 5,839,149 disclose toothbrushes whose head is formed of a rigid frame supporting a flexible resilient member which has a series of linearly parallel lines or arrays of bristle tufts, which lines of bristle tufts are oriented along the longitudinal axis of the toothbrush. In each of the these patents the parallel lines of bristles are flexibly mounted, such that in brushing when a tooth is forced against the center line of tufts, that line of tufts will yield away from the tooth, causing the adjacent lines of bristle tufts to orient themselves about the sides of the tooth. As this contouring about the tooth is in two dimensions, these patents fail to address the overall three dimensional curvature of the teeth, especially the deep "v" shaped interproximal area between one tooth and the next.

U.S. Pat. No. 5,651,158 discloses a flexible head toothbrush having many embodiments, including a first embodiment in which the bristles may be mounted on head segments linked by grooves or thinned, i.e. flexible, connections which may be filled with a resilient elastomer. A second embodiment comprises a toothbrush head having bristle mounting segments within a hard peripheral frame, the segments being linked at planar points located 90° to the longitudinal axis of the handle, the linkage being of thinned sections such that the segments may be made to rock about these links, in addition to flexing. A third embodiment includes a hard peripheral frame containing a toothbrush head formed of one or more chains of bristle carriers, flexibly and resiliently linked to each other and linked to at least one end of the frame. A fourth embodiment is formed of segments which are not joined to each other, but are flexibly and resiliently linked to the handle or to the frame, wherein the linkage to the frame may be by thinned sections or spines. In each embodiment the various segments or bristle carriers will flex independently or at most in coordination with the adjacent segments or bristle carriers within the chain of bristle carriers; such limited coordination of the orientation of the bristle tufts about the tooth will not provide the conformation to the various arcuate surfaces of the tooth surfaces necessary for effective cleaning.

There is a need for a toothbrush, wherein the bristles coordinate their orientation to conform to the three dimensional arcuate tooth surfaces and the deep "v" shaped interproximal area between one tooth and the next, such as to provide effective overall cleaning.

SUMMARY OF THE INVENTION

The present invention encompasses a toothbrush having bristle tufts which are capable of enhanced conformity to the arcuate tooth surfaces, said toothbrush comprised of a handle having a longitudinal axis and at one end thereof a head containing a plurality of bristle tufts extending therefrom; which head has a surrounding rigid periphery with an aperture extending therethrough and across which is a lattice or open network of flexibly resilient spines; wherein, each bristle tuft is anchored to said head at a node formed by the intersection of said spines. The lattice has a portion which is free of spines, this portion being located central to the head and on each side of the longitudinal axis, such that the lattice segments on each side of the longitudinal axis will flex independently. Each lattice segment flexes such that during brushing, as a tooth is forced against a bristle tuft, that bristle tuft will yield into the aperture and the immediate surrounding bristle tufts will tend to deflect toward that particular tooth, such deflecting bristle tufts conforming about the arcuate, three dimensional, surfaces of the particular tooth for more effective cleaning thereof.

DETAILED DESCRIPTION OF THE INVENTION

Figure 1:
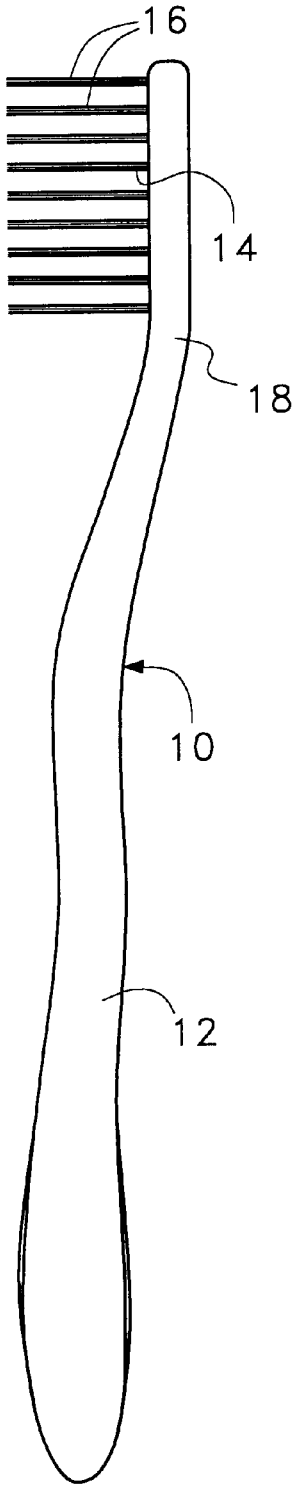
FIG. 1 is a side plan view, showing the toothbrush with a typical flat bristle pattern.
Figure 2:
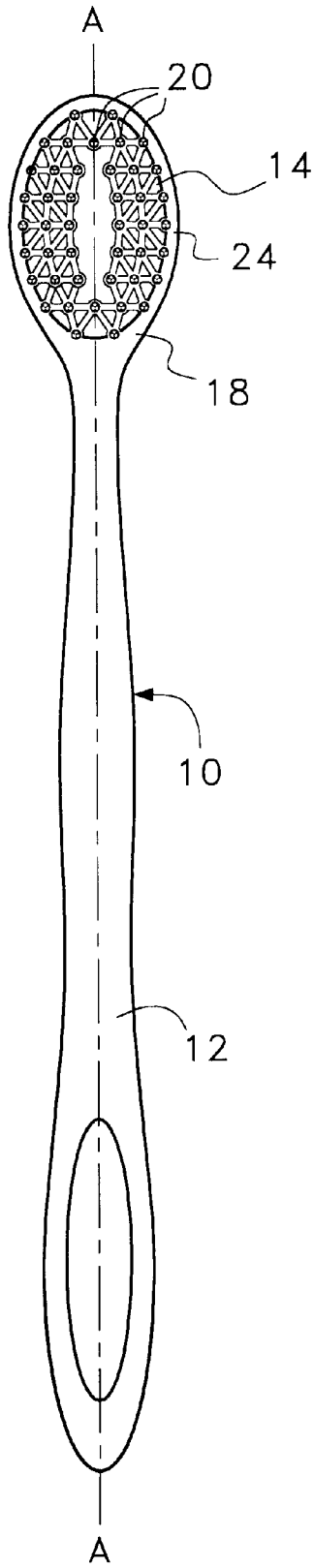
FIG. 2 is a front plan view of the toothbrush showing within the head section the network of bristle tuft carriers supporting the bristles shown in FIG. 1.

Referring now to the drawings, wherein like reference numerals refer to the same or similar elements among the several figures, and in particular to FIGS. 1 and 2; wherein there is shown a toothbrush, 10, in accordance with the present invention. Referring specifically to FIG. 2, a front plan view of such a toothbrush, 10, having head, 18, integral to a handle, 12, extending therefrom and a longitudinal axis, A—A, therethrough. The head, 18, contains a face, 14, which has a central concavity across which is a lattice or open network of flexibly resilient bristle carriers embodying the features and construction of this invention. Shown in FIG. 1, extending from the face, 14, are rows of bristle tufts, 16, transverse to the longitudinal axis A—A. Each bristle tuft, 16, is embedded and supported by a bristle tuft at each node, 20, which carrier located nodes as can be seen in FIG. 3, are formed at the junction at which the structural elements or spines, 22, of the lattice intersect.

Figure 3:
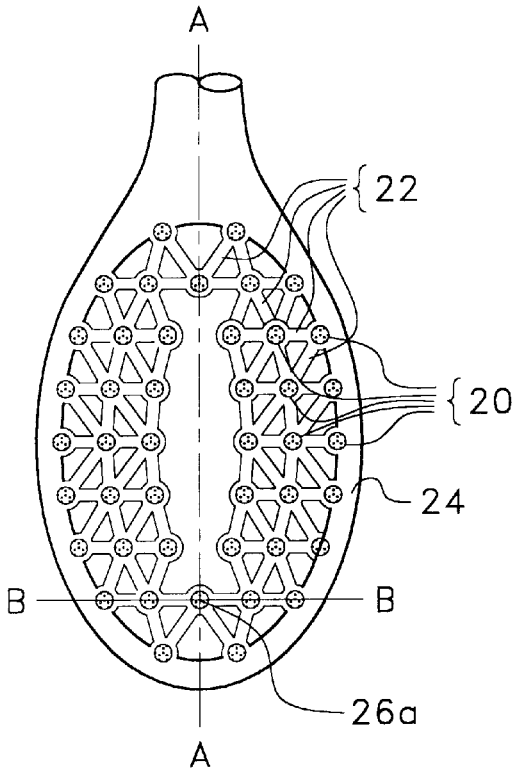
FIG. 3 is an enlarged front plan view of the toothbrush head shown in FIG. 2.
Figure 4:
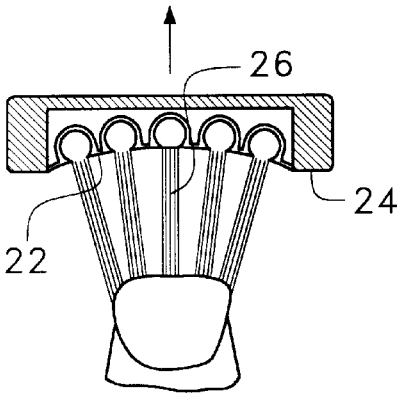
FIG. 4 is a section view, through section B—B of FIG. 3, showing in two dimensions the conformation of the bristles about the arcuate surfaces of a typical tooth.

As in FIG. 3, the face of the toothbrush of the present invention, 14, has a peripheral frame or rigid periphery, 24, the rigid periphery defining an opening or aperture extending through the toothbrush head, 18. Alternatively, the toothbrush can also be formed with a closure across the back of the toothbrush head, 18, in the form of a concave segment below and separated from the lattice. In the case where the back of the toothbrush is enclosed, the concavity below the lattice can extend from 50 to 80% of the distance from the face to back, i.e. the depth of the toothbrush head, which depth is up to about ¼ of an inch. The deflection of the bristle tuft carriers into the concavity, during brushing, is illustrated by FIG. 4, which is a cross-section B—B of FIG. 3, perpendicular to the longitudinal axis A—A of the toothbrush. FIG. 4 illustrates only the conformation of the bristles about the tooth in two dimensions with the deflection of the center bristle tuft, 26, in the direction of the arrow in FIG. 4. Referring to FIG 3, it can be seen that the deflection of bristle tuft, 26, extending from the bristle tuft carrier at node 26*a*, will not only cause the adjacent bristle tufts perpendicular to the longitudinal axis A—A to deflect toward node 26*a* and conform to the tooth; but, also the adjacent bristle tufts parallel to the longitudinal axis A—A will deflect toward and conform about the tooth providing the present inventions three dimensional conformity to the tooth for effective cleaning thereof.

Further, within the present invention the lattice of spines extending across the face, 14, of the toothbrush has a central portion free of said spines, such that the spines located central to the head, 18, and parallel to the longitudinal axis, A—A, do not intersect, i.e. are not connected (see FIG. 3). This discontinuity within the lattice allows the separate tuft supporting network segments, on each side of the longitudinal axis, to move independently. Such independent movement of the tuft supporting network segments facilitates the toothbrushes simultaneous cleaning of different teeth and areas of the dentiture as occurs during brushing.

The head, 18, comprised of the neck, the peripheral frame, 24, and the lattice or network of flexibly resilient bristle carriers is preferably integral with the toothbrushes handle, 12, i.e. molded or otherwise formed as a single piece. The periphery of the head, 24, is at least 1/32 of an inch in width, and preferably at least 1/16 of an inch in width, so as to be rigid enough to adequately support the network of nodes, 20, attached thereto.

Figure 6:
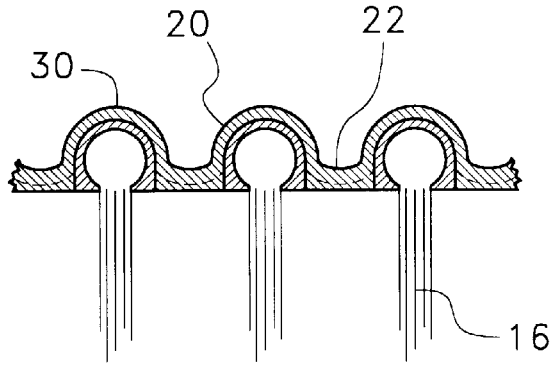
FIG. 6 is an alternate detail of the bristle tufts as shown in FIG. 5, i.e. the fused ends of the bristle tufts secured together by the connecting spines overmolded with an elastomer.

The network of bristle tuft carriers, including the spines, 22, and nodes, 20, are of a flexible and resilient maternal, preferably of polypropylene. Alternatively, the spines, 22, can be of polyethylene or thermoplastic elastomer (TPE), or a combination thereof. The degree, of flexibility and resilience of the spines, 22, can be further controlled by varying their dimensions, e.g. reducing the depth or thickness of each spine, 22, to provide additional flexibility or by providing an overcoating, 30, of a second elastomer about each spine, 22, and node, 20, as illustrated in FIG. 6. Acceptable TPE materials, including athermoplastic vulcanate (TPV) which consists of a mixture of polyproplyene and EPDM (ethylene propylene diene monomers) which is available as Santoprene (brand), described in U.S. Pat. No. 5,393,796; or Vyram (brand), another TPV consisting of a mixture of polypropylene and natural rubber, both Santoprene and Vyram being elastomers marketed by Advanced Elastomer Systems LP, Akron, Ohio 44311. Another, and preferred TPE is Dynaflex G6713 (brand), marketed by GLS Corp., Cary, Ill. 60013. These and other suitable elastomers have, typically, a Shore A hardness of from about 13 to 94, with about 29 being a preferred hardness.

Toothbrushes today are typically molded of polyproplyene, in the present invention it is preferred that the lattice or network of bristle tuft carriers also be of polyproplyene to facilitate one-step molding of the toothbrush. If a clear appearance is desired, the handle, 12, head, 18, and lattice can be of polyester, such as polyethylene terephthalate. A preferred polypropylene is Huntsman Polypropylene 5520 (Brand), manufactured by the Huntsman Polypropylene Corporation, Hinsdale, Ill. 60521.

If desired, the toothbrush of the present invention can be molded as a "dual component" toothbrush, by which is meant that the flexibly resilient material of the bristle supporting network or lattice is of a material different than that of the hard plastic toothbrush head, 18, and handle, 12. The method of manufacture of such a dual component toothbrush by conventional dual component injection molding technology is well known in the art. For example, in accordance with the present invention, the lattice material may be introduced into the head area by a second injection step, after that used for the injection molding of the hard bristle implanting head and handle. In this second injection step the semi-finished toothbrush is positioned in a second mold into which the lattice material is injected about the interior of the rigid periphery, 24. To increase the surface area for the elastomer to adhere to the rigid periphery, 24, for increased adhesion thereto, a groove or recess can be provided about the upper surface of the interior of the rigid periphery.

A one-step molding process can be utilized in the manufacture of toothbrushes of the present invention, when the head, 18, contains an aperture extending therethrough and when the lattice is of the same material as the remainder of the toothbrush frame, i.e. the head, 18, and handle, 12. In contrast, a two-step molding process must be used whenever the head, 18, of the toothbrush contains a concavity below the lattice, this concavity is formed by the toothbrush having an enclosed back, such enclosure being separated from the lattice. In such a two-step molding process, the toothbrush frame and integral lattice are formed in a first injection mold and the semi-finished toothbrush is repositioned in a second injection mold, wherein the back enclosure is formed.

Facilitation of two step injection molding of toothbrushes of the present invention can be by using a two component mold. Two component molds are available from Machines Boucherie N.V., Izegem, Belgium; which molds can be mounted in typical injection molding machines for such implementing the two step injection process, such machines including 300 ton, two component injection molding machines available from Engel Canada, Inc., Guelph, Ontario.

Figure 5:
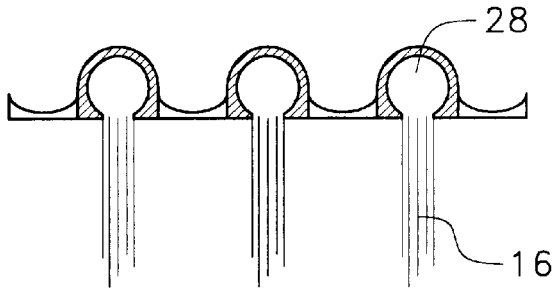
FIG. 5 is a detail of the bristle tufts, showing the nodes within the network of bristle tuft carriers, i.e. the fused ends of the bristle tufts secured together by the connecting spines.

The toothbrush bristles may be implanted as the nodes of the flexibly resilient elastomeric material of the bristle supporting network are formed using non-staple, in-mold tufting (IMT) technology as disclosed in U.S. Pat. Nos. 5,609,890, 5,390,984, and 5,533791. Such IMT technology involves a process and the associated machinery wherein each tuft of bristles is first pre-formed into an assembly by fusing its base of bristles together into a knob. This knob is then held in the mold into which the flexibly resilient material of the bristle supporting network or lattice is injected, such that the material flows about the knob, anchoring the tuft into place within the toothbrush face, 14. FIG. 5 illustrates finished IMT tufts of bristles, 16; wherein, the material of the bristle supporting network, i.e. the spines, 22, surrounds and anchors the knob, 28, at the base of each bristle tuft, 16.

What is claimed is:

1. A toothbrush having bristle tufts capable of providing enhanced conformity to arcuate tooth surfaces, comprising:

a handle having a longitudinal axis and a head at one end thereof, which head contains a face having a plurality of said bristle tufts extending therefrom;

said face having a rigid periphery, within which rigid periphery is an aperture extending therethrough;

a network of flexibly resilient spines forming a lattice extending across said aperture and attached to said rigid periphery;

said lattice having a center portion which is free of said spines;

said lattice having nodes located at the intersection of said spines, each node having one of said bristle tufts anchored therein.

2. The toothbrush of claim 1, wherein the rigid periphery is at least 1/32 of an inch in width.

3. The toothbrush of clam 1, wherein the spines are of a flexible and resilient material selected from the group consisting of polypropylene, polyethylene, a thermoplastic elastomer and a combination thereof.

4. A toothbrush exhibiting enhanced conformity to arcuate tooth surfaces for enhanced cleaning, comprising:

a handle having a longitudinal axis and a head at one end thereof, which head contains a face having a plurality of bristle tufts extending therefrom;

said face having a rigid periphery, to which rigid periphery is attached a network of flexibly resilient spines forming a lattice extending across said face;

said lattice having a center portion which is free of said spines;

said lattice having nodes located at the intersection of the spines, each node having one of said bristle tufts anchored therein;

said head having a concave portion therein, beneath said lattice and extending across said head.

5. The toothbrush of claim 4, wherein the concave portion can extend from 50 to 80% of the depth of the toothbrush head.

6. The toothbrush of claim 4, wherein the rigid periphery is at least 1/32 of an inch in width.

7. The toothbrush of clam 4, wherein the spines are of a flexible and resilient material selected from the group consisting of polypropylene, polyethylene, a thermoplastic elastomer and a combination thereof.

* * * * *